US010344365B2

(12) United States Patent
Mueller et al.

(10) Patent No.: US 10,344,365 B2
(45) Date of Patent: Jul. 9, 2019

(54) MAGNESIUM-ZINC-CALCIUM ALLOY AND METHOD FOR PRODUCING IMPLANTS CONTAINING THE SAME

(71) Applicant: BIOTRONIK AG, Buelach (CH)

(72) Inventors: Heinz Mueller, Diedrichshagen (DE); Peter Uggowitzer, Ottenbach (CH); Joerg Loeffler, Greifensee (CH)

(73) Assignee: BIOTRONIK AG, Buelach (CH)

( * ) Notice: Subject to any disclaimer, the term of this patent is extended or adjusted under 35 U.S.C. 154(b) by 291 days.

(21) Appl. No.: 14/396,012

(22) PCT Filed: Jun. 25, 2013

(86) PCT No.: PCT/EP2013/063253
§ 371 (c)(1),
(2) Date: Oct. 21, 2014

(87) PCT Pub. No.: WO2014/001321
PCT Pub. Date: Jan. 3, 2014

(65) Prior Publication Data

US 2015/0129092 A1 May 14, 2015

Related U.S. Application Data

(60) Provisional application No. 61/664,224, filed on Jun. 26, 2012, provisional application No. 61/664,274, filed on Jun. 26, 2012, provisional application No. 61/664,229, filed on Jun. 26, 2012.

(30) Foreign Application Priority Data

Feb. 1, 2013 (DE) ..... 10 2013 201 696

(51) Int. Cl.
*C22F 1/06* (2006.01)
*C22C 23/04* (2006.01)

(52) U.S. Cl.
CPC ..... *C22F 1/06* (2013.01); *C22C 23/04* (2013.01)

(58) Field of Classification Search
CPC ..... C22C 23/04; C22F 1/06
USPC ..... 148/538
See application file for complete search history.

(56) References Cited

U.S. PATENT DOCUMENTS

| | | | |
|---|---|---|---|
| 3,320,055 | A | 5/1967 | Foerster |
| 5,055,254 | A | 10/1991 | Zuliani |
| 5,698,158 | A | 12/1997 | Lam et al. |
| 8,518,102 | B2 | 8/2013 | Kitaoka |
| 9,072,618 | B2 | 7/2015 | Doerr et al. |
| 9,593,397 | B2 | 3/2017 | Imwinkelried et al. |
| 9,677,151 | B2 | 6/2017 | Wegmann et al. |
| 9,561,308 | B2 | 9/2017 | Schaffer |
| 2008/0031765 | A1 | 2/2008 | Gerold et al. |
| 2009/0171452 | A1 | 7/2009 | Yamamoto et al. |
| 2010/0075162 | A1 | 3/2010 | Yang et al. |
| 2011/0054629 | A1 | 3/2011 | Seok et al. |
| 2011/0076178 | A1 | 3/2011 | Somekawa et al. |
| 2011/0192500 | A1 | 8/2011 | Uggowitzer et al. |
| 2011/0315282 | A1 | 12/2011 | Somekawa et al. |
| 2012/0035740 | A1 | 2/2012 | Koo et al. |
| 2012/0095548 | A1 | 4/2012 | Gregorich et al. |
| 2012/0269673 | A1 | 10/2012 | Koo et al. |
| 2013/0039805 | A1 | 2/2013 | Somekawa et al. |
| 2013/0131814 | A1 | 5/2013 | Koo et al. |
| 2013/0144290 | A1 | 6/2013 | Schiffl |
| 2014/0065009 | A1 | 3/2014 | Imwinkelried et al. |
| 2014/0261911 | A1 | 9/2014 | Imwinkelried et al. |
| 2015/0047756 | A1 | 2/2015 | Washio et al. |
| 2015/0080938 | A1 | 3/2015 | Groff |
| 2015/0080998 | A1 | 3/2015 | Mueller |
| 2015/0119995 | A1 | 4/2015 | Mueller et al. |
| 2015/0129091 | A1 | 5/2015 | Mueller |
| 2015/0129092 | A1 | 5/2015 | Mueller |
| 2016/0022876 | A1 | 1/2016 | Imwinkelried et al. |

FOREIGN PATENT DOCUMENTS

| | | | | |
|---|---|---|---|---|
| CN | 1743486 | A | | 3/2006 |
| CN | 1792383 | | | 6/2006 |
| CN | 1792383 | A | * | 6/2006 |
| CN | 1792384 | A | | 6/2006 |
| CN | 101629260 | A | | 1/2010 |
| CN | 101658691 | | | 3/2010 |
| CN | 101308105 | | | 8/2010 |
| CN | 101899600 | A | | 12/2010 |
| CN | 102312144 | | | 1/2012 |
| CN | 101658691 | | | 9/2017 |

(Continued)

OTHER PUBLICATIONS

NPL-1: On-line translation of Zhang et al, CN 1792383A, Jun. 2006.*

NPL-2: Chen et al, In vivo degradation and bone response of a composite coating on Mg—Zn—Ca alloy prepared by micro-arc oxidation and electrochemical deposition, 2011 Willey periodicals, Inc, published online Nov. 2011, pp. 533-543.*

Kammer, Catrin, et al., "Magnesium Taschenbuch", Aluminium-Verlag, Duesseldorf (2000), pp. 156-161.

Li Xuesong, et al., "Microstructure, mechanical properties and corrosion behavior of Mg-1Zn-0.5Ca alloy", Advanced Materials Research, Trans Tech Publications Ltd., vol. 311-313, Jan. 1, 2011, pp. 1735-1740.

Martienssen, Werner, et al, "Springer Handbook of Condensed Matter and Materials Data—Part 3.1", Springer-Verlag Berlin Heidelberg, New York, (2005), pp. 160-170 and cover pages (23 pages).

(Continued)

*Primary Examiner* — Jie Yang
(74) *Attorney, Agent, or Firm* — White & Case LLP

(57) ABSTRACT

A magnesium alloy includes <3% by weight of Zn, ≤0.6% by weight of Ca, with the rest being formed by magnesium containing impurities, which favor electrochemical potential differences and/or promote the formation of intermetallic phases, in a total amount of no more than 0.005% by weight of Fe, Si, Mn, Co, Ni, Cu, Al, Zr and P, wherein the alloy contains elements selected from the group of rare earths with the atomic number 21, 39, 57 to 71 and 89 to 103 in a total amount of no more than 0.002% by weight.

24 Claims, No Drawings

(56) References Cited

FOREIGN PATENT DOCUMENTS

| | | | |
|---|---|---|---|
| DE | 1483204 | | 10/1969 |
| DE | 102006060501 | A1 | 6/2008 |
| DE | 102010027532 | B4 | 6/2014 |
| EP | 0295397 | A1 | 12/1988 |
| EP | 1959025 | | 8/2008 |
| EP | 2295613 | | 3/2011 |
| EP | 2384725 | | 11/2011 |
| EP | 2384725 | A1 | 11/2011 |
| EP | 2085100 | B1 | 1/2015 |
| JP | 02047238 | | 2/1990 |
| JP | 07018364 | | 1/1995 |
| JP | H11502565 | | 3/1999 |
| JP | 2010163635 | | 7/2010 |
| JP | 2010529288 | | 8/2010 |
| JP | 2010529288 | A | 8/2010 |
| JP | 2011502565 | A | 1/2011 |
| JP | 2012082474 | | 4/2012 |
| RU | 2098506 | | 12/1997 |
| RU | 2437949 | | 12/2011 |
| WO | 9626297 | | 8/1996 |
| WO | 1997040201 | | 10/1997 |
| WO | 2004013364 | | 2/2004 |
| WO | 2005108634 | | 11/2005 |
| WO | 2007058276 | | 5/2007 |
| WO | 2007058276 | A1 | 5/2007 |
| WO | 2008016150 | | 2/2008 |
| WO | 2009/147861 | A1 | 12/2009 |
| WO | 2009148093 | | 12/2009 |
| WO | 2010082669 | | 7/2010 |
| WO | 2011051424 | | 5/2011 |
| WO | 2011051424 | A1 | 5/2011 |
| WO | 2011114931 | | 9/2011 |
| WO | 2012003522 | | 1/2012 |
| WO | 2013107644 | | 7/2013 |
| WO | 2014001321 | | 1/2014 |
| WO | 2014001321 | A1 | 1/2014 |
| WO | 2014159328 | | 10/2014 |

OTHER PUBLICATIONS

Oh, J.C., et al., "TEM and 3DAP characterization of an age-hardened Mg—Ca—Zn alloy", Scripta Materialia, vol. 53, No. 6, Sep. 1, 2005, pp. 675-679.

Oh-Ishi, K., et al., "Age-hardening response of Mg-0.3 at.%Ca alloys with different Zn contents," Materials Science and Engineering, A: vol. 526, Nos. 1-2, Nov. 25, 2009, pp. 177-184.

Oh-Ishi, K., et al., "Influence of Zn additions on age hardening response and microstructure of Mg-0.3at.% Ca alloys", Magnesium Technology 2010, "Proceedings of a Symposium Held During [the] TMS Annual Meeting & Exhibition," Jan. 1, 2010, pp. 517-520.

Schuetze, Michael, et al., "Fundamentals of High Temperature Corrosion", Materials Science and Technology, Wiley-VCH Verlag GmbH, 2000, pp. 67-129.

Somekawa, H., et. al., "High strength and fracture toughness balance on the extruded Mg—Ca—Zn alloy", Materials Science and Engineering: A, vol. 459, Nos. 1-2, Jun. 25, 2007, pp. 366-370.

Song, G., et al., "Corrosion of Non-Ferrous Alloys. III. Magnesium Alloys", Materials Science and Technology, WILEY-VCH Verlag GmbH, 2000, pp. 131-171.

Yang, M.B., et al., "Comparison of as-cast microstructures and solidification behaviours of Mg—Zn—Al ternary magnesium alloys with different Zn/Al mass ratios," Advanced Materials Research, Trans Tech Publications Ltd., vol. 548, Jan. 1, 2012, pp. 321-327.

Zhang, B.P., et al., "Enhanced mechanical properties in fine-grained Mg-1.0Zn-0.5Ca alloys prepared by extrusion at different temperatures", Scripta Materialia, vol. 63, No. 10, Nov. 1, 2010, pp. 1024-1027.

Radeck, Stephanie, "International Search Report and Written Opinion of the International Searching Authority", Patent Cooperation Treaty Application PCT/EP2013/063253, European Patent Office as International Search Authority, Search Completed Sep. 26, 2013, International Search Report dated Oct. 4, 2013, 13 pages.

Chen, Ji-Hua, et al. , "Microstructural stability and mechanical properties of Mg—Zn—Al alloys", Hunan-Daxue Bao I Ziran-Kexue-Ban =Journal of Hunan University/Hunan Daxue Zhuban, vol. 34, No. 1, Jan. 1, 2007, pp. 47-51.

Kammer, Catrin, et al., "Magnesium Taschenbuch", Aluminium-Verlag, Duesseldorf (2000), pp. 156-161 (English language machine translation).

Kannan et al., Evaluating the stress corrosion crackihnhg susceptibility of Mg—Al—Zn alloy in modified-simulated body fluid for orthopaedic implant application, Scripta Materialia, 59 (2008) pp. 175-178.

Radeck, Stephanie, "International Search Report" Patent Cooperation Treaty Application No. PCT/EP2013/062876, European Patent Office as International Search Authority, Oct. 16, 2013, 5 pages.

Sun, Yu, et al., "Preparation and characterization of a new biomedical MgZnCa alloy", Materials and Design, vol. 34, Jul. 23, 2011 , pp. 53-64.

Zou, H., et al., Effects of microstructure on creep behavior of Mg-5%Zn-2%Al(-2%Y) alloy, Trans. Nonferrous Met. Soc. China, vol. 18, No. 3, (Jun. 2008), pp. 580-587.

Zou, H., et al., "Effects of ND on the Microstructure and Mechanical Property of ZA52 Alloy", Materials Science Forum, vols. 488-489, (2005), pp. 161-164.

Bakhsheshi-Rad, et al., Characterization and Corrosion Behavior of Biodegradable Mg—Ca and Mg—Ca—Zn Implant Alloys, Appl. Mech. Mater, Jan. 2012, 121-126, 568-572 (Abstract Only).

Sun, Yu, et al., Preparation and Characterization of a New Biomedical Mg—Zn—Ca Alloy, Materials and Design, vol. 34, pp. 56-64, Feb. 2012 (Abstract Only).

Koike, Junichi, Dislocation Plasticity and Complementary Deformation Mechanisms in Polycrystalline Mg Alloys, Mater. Sci. Forum, Mar. 2004, 4999-452, 665-668 (Abstract Only).

Wilson, D.V., et al., Effects of Preferred Orientation on the Grain Size Dependence of Yield Strength in Metals, Philos. Mag., Jun. 1963, 1543-1551 (Abstract Only).

L'Ecuyer, J.D., et al., Precipitation Interactions with Dynamic Recrystallization of HSLS Steel, Acta Metallurigica, Apr. 1989, 37, 4, 1023-1031 (Abstract Only).

International Search Report for PCT/US2014/023047, dated Jan. 31, 2014.

International Search Report for PCT/US2013/057294, dated Jun. 17, 2014.

Xu, Bingshe, et al., 1200 Questions on Nonferrous Metallurgy; 747, How to Prepare Highly Pure Magnesium, Chemical Industry Press, p. 252, Jan. 1, 2008.

Chen, Ji-Hua, et al. , "Microstructural stability and mechanical properties of Mg—Zn—Al alloys", Hunan-Daxue-Xue Bao I Ziran-Kexue-Ban =Journal of Hunan University/ Hunan Daxue Zhuban, vol. 34, No. 1, Jan. 1, 2007, pp. 47-51.

Friedrich, Horst, E., et al., "Magnesium Technology", Jan. 1, 2006 (Jan. 1, 2006 ), Springer, Berlin Heidelberg New York, pp. p. 231-232; p. 289-301; p. 308-315.

Geis-Gerstorfer, J., et al., "Blood triggered corrosion of magnesium alloys", Materials Science and Engineering B, 176, (2011), pp. 1761-1766.

He, You Ii an, et al., "Production of Very Fine Grained Mg-3%Al-1 %Zn Alloy by Continuous Extrusion Forming (CONFORM)", Advanced Engineering Materials, 12, No. 9, (2010), pp. 843-847.

Hillis et al., "Compositional Requirements for Quality Performance with High Purity," International Magnesium Association Meeting; 55th, International Magnesium Association, (1998), pp. 74-81.

Jin, Li, et al., "Mechanical properties and microstructure of AZ31 Mg alloy processed by two-step equal channel angular extrusion", Materials Letters, 59, (2005), pp. 2267-2270.

JP Office Action for Application No. 2015519055, dated Jun. 1, 2017.

Kawamura, Yuji et al. "Office Action" Japanese Patent Application No. 2015-518992, dated May 30, 2017 (15 pages).

Kim, Ye-Lim, et al., "Effect of Al Addition on the Precipitation Behavior of a Binary Mg—Zn", Kor. J. Mater. Res., vol. 22, No. 3, (2012), pp. 111-117.

(56) References Cited

OTHER PUBLICATIONS

Liu, Qiang, et al., "Influences of Al on Microstructures and Properties of Mg—6Zn Alloys", Kuangye-Gongcheng = Mining and Metallurgical Engineering, vol. 25, No. 5, Oct. 1, 2005, pp. 74-76.
Radeck, Stephanie, "International Search Report" Patent Cooperation Treaty Application No. PCT/EP2013/062876, European Patent Office as International Search Authority, dated Oct. 16, 2013, 5 pages.
Radeck, Stephanie, "International Search Report and Written Opinion of the International Searching Authority", Patent Cooperation Treaty Application PCT/EP2013/063110, European Patent Office as International Search Authority, Search Completed Oct. 1, 2013, International Search Report dated Dec. 2, 2013, 10 pages.
Radeck, Stephanie, "Office Action" for EP Office Action Application No. 13730893.8, dated Apr. 19, 2017.
Radeck, Stephanie, "Office Action" for EP Office Action Application No. 13731134.6, dated Apr. 19, 2017.
Radeck, Stephanie, "Office Action" for EP Office Action Application No. 13729770.0, dated Apr. 19, 2017.
Radeck, Stephanie, "Office Action" for EP Office Action Application No. 13730613.0, dated Apr. 19, 2017.
RU Office Action for Application No. 2015101291/02, dated Jun. 2, 2017.
RU Office Action for Application No. 2015102166/02, dated Jun. 2, 2017.
RU Office Action for Application No. 2015102168/02, dated Jun. 2, 2017.
Sun, Yu, et al., "Preparation and characterization of a new biomedical MgZnCa alloy", Materials and Design, vol. 34, Jul. 23, 2011 , pp. 58-64.
Wang, Jinyong, "Notification of the First Office Action," Chinese Patent Application No. 201380022063.0, dated Feb. 1, 2016, 10 pages.
Wang, Xi-Shu, et al., "Effect of equal channel angular extrusion process on deformation behaviors of Mg—3Al—Zn alloy", Materials Letters, 62, (2008), pp. 1856-1858.
Wenjiang, Ding, "Science and Technology of Magnesium Alloys," Science Publishing House, Jan. 2007, pp. 323-324.
Xi, Ai, "Notification of the First Office Action", Chinese Patent Application 201380022714.6, dated Mar. 9, 2016, 7 pages.
Xie, Yang, State Intellectual Property Office of the People's Republic of China Notification of the First Office Action , Application No. 201380022716.5, dated Mar. 3, 2016, 11 pages.
Xu, Yang, State Intellectual Property Office of the People's Republic of China Notification of the First Office Action, Application No. 201380022712.7, dated Feb. 29, 2017, 8 pages.
Xu, Yang, State Intellectual Property Office of the People's Republic of China Notification of the Second Office Action, Application No. 201380022712.7, dated Nov. 18, 2016, 10 pages.
Xu, Yang, State Intellectual Property Office of the People's Republic of China Notification of the Third Office Action, Application No. 201380022712.7, dated May 25, 2017, 10 pages.
Zhou, H., et al. Effects of Microstructure on Creep Behavior of Mg—5%Zn—2%Al(—2%Y) Alloy, Trans. Nonferrous Met. Soc. China, vol. 18, No. 3 (Jun. 2008), pp. 580-587.
Zhou, H., et al, Effects of Nd on the Microstructure and Mechanical Property of ZA52 Alloy, Materials Science Forum, vols. 488-489, (2005), pp. 161-164.
ASTM International, Standard Specification for Magnesium-Alloy Die Castings, 1998.
European Committee for Standardization, Magnesium and Magnesium Alloys, 1998.
Hanawalt, et al., Corrosion Studies of Magnesium and Its Alloys, Metals Technology, Sep. 1941, 273-299.
Li, Wen, et al., Preparation and in Vitro Degradation of the Composite Coating with High Adhesion Strength on Biodegradable Mg—Zn, Ca Alloy, Materials Characterization 62 (2011), 1158-1165.
Cha, Pil-Ryung, et al., Biodegradability Engineering of Biodegradable Mg Alloys: Tailoring the Electrochemical Properties and Microstructure of Constituent Phases, Scientific Reports 3:2367, 1-6, 2013.
Song, Yingwei, et al., The Role of Second Phases in the Corrosion Behavior of Mg—5Zn Alloy, Corrosion Science 60 (2012) 238-245.
Abidin, Nor Ishida Zainal, et al., Corrosion of High Purity Mg, Mg2Zn0.2Mn,ZE41 and AZ91 in Hank's Solution at 37° C., Corrosion Science 53 (2011) 3542-3556.
Bakhsheshi-Rad, H.R., et al., Relationship Between the Corrosion Behavior and the Thermal Characteristics and Microstructure of Mg—0.5Ca—xZn Alloys, Corrosion Science 64 (2012) 184-197.
Sugiura, Tsutomu, et al., A Comparative Evaluation of Osteosynthesis with Lag Screws, Miniplates, or Kirschner Wires for Mandibular Condylar Process Fractures, J. Oral Maxillofac Surg 59:1161-1168, 2001.
Manohar, P.A., et al., Five Decades of the Zenar Equation, ISIJ International, vol. 38 (1998), No. 9, pp. 913-924.
Wang, Bin, et al., Biocorrosion of Coated Mg—Zn—Ca Alloy under Constant Compressive Stress Close to that of Human Tibia, Materials Letters 70 (2012) 174-176.
Barnett, M.R., et al., Influence of Grain Size on the Compressive Deformation of Wrought Mg—3Al—1Zn, Acta Materiala 52 (2004) 5093-5103.
Du, Hui, et al., Effects of Zn on the Microstructure, Mechanical Property and Bio-Corrosion Property of Mg—3CA Alloys for Biomedical Application, Materials Chemistry and Physics 125 (2011) 568-575.
Kirkland, Nicholas, et al., In Vitro Dissolution of Magnesium-Calcium Binary Alloys: Clarifying the Unique Role of Calcium Additions in Bioresorbable Magnesium Implant Alloys, Wiley Online Library, 2010, 91-100.
Zhang, Erlin, et al., Microstructure, Mechanical Properties and Bio-Corrosion Properties of Mg—Zn—Mn—Ca Alloy for Biomedical Application, Materials Science and Engineering A 497 (2008) 111-118.
Song, Guang Ling, et al., Understanding Magnesium Corrosion, A Framework for Improved Alloy Performance, Advanced Engineering Materials, 2003, 5, No. 12, 837-858.
Song, Guang Ling, et al., Corrosion Mechanisms of Magnesium Alloys, Advanced Engineering Materials, 1999, 1, No. 1, 11-33.
Abidin, Nor Ishida Zainal et a.., The In Vivo and in Vitro Corrosion of High-Purity Magnesium and Magnesium Alloys WZ21 and AZ91, Corrosion Science 75 (2013) 354-366.
Kirkland, N.T., et al., Assessing the Corrosion of Biodegradable Magnesium Implants: A Critical Review of Current Methodologies and Their Limitations, Acta Biomaterialia 8 (2012) 925-936.
Kirkland, Nicholas T., et al., Buffer-Regulated Biocorrrosion of Pure Magnesium, J. Mater Sci: Mater Med. (2012) 23: 283-291.
Hanzi, Anja C., et al., On the In Vitro and In Vivo Degradation Performance and Biological Response of New Biodegradable Mg—Y—Zn Alloys, Acta Biomateriala 6 (2010) 1824-1833.
Yamamoto, Akiko, et al., Effect of Inorganic Salts, Amino Acids and Proteins on the Degradation of Pure Magnesium in Vitro, Materials Science and Engineering C 29 (2009) 1559-1568.
Cao, Fuyong, et al., Corrosion of Ultra-High-Purity Mg in 35% NaCl Solution Saturated with Mg(OH)2, Corrosion Science 75 (2013) 78-99.
Kalb, H., et al., Impact of Microgalvanic Corrosion on the Degradation Morphology of WE43 and Pure Magnesium under Exposure to Simulated Body Fluid, Corrosion Science 57 (2012) 122-130.
Schinhammer, Michael, et al., On the Immersion Testing of Degradable Implant Materials in Simulated Body Fluid: Active pH Regulation Using CO2, Advanced Engineering Materials, 2013, 15, No. 6, 434-441.
Liu, Ming, et al., Calculated Phase Diagrams and the Corrosion of Die-Cast Mg—Al Alloys, Corrosion Science, 2009, 602-619.
Pilcher, Karin, et al., Immunological Response to Biodegradable Magnesium Implants, JOM, vol. 66, No. 4, 2014.
Kraus, Tanja, et al., Magnesium Alloys for Temporary Implants in Osteosynthesis: In Vivo Studies of their Degradation and Interaction with Bone, Acta Biomaterialia 8 (2012) 1230-1238.

(56) References Cited

OTHER PUBLICATIONS

Homma, T., et al., Effect of Zr Addition on the Mechanical Properties of As-Extruded Mg—Zn—Ca—Zr Alloys, Materials Science and Engineering A 527 (2010) 2356-2362.
Mendis, C.L., et al., Precipitation-Hardenable Mg—2.4Zn—0.1Ag—0.1Ca—0.16Zr (at.%) Wrought Magnesium Alloy, Acta Materialia 57 (2009) 749-760.
Koike, J., et al., The Activity of Non-Basal Slip Systems and Dynamic Recovery at Room Temperature in Fine-Grained AZ31B Magnesium Alloys, Acta Materialia 51 (2003) 2055-2065.
Hanzi, A.C., et al., Design Strategy for Microalloyed Ultra-Ductile Magnesium Alloys, Philosophical Magazine Letters, vol. 89, No. 6, Jun. 2009, 377-390.
Bamberger, M., et al., Trends in the Development of New Mg Alloys, Annu. Rev. Mater. Res. 2008, 38:505-33.
Farahany, Saeed, et al., In-Situ Thermal Analysis and Macroscopical Characterization of Mg—xCA and Mg—0.5Ca—xZn Alloy Systems, Thermochimica Acta 527 (2012) 180-189.
Zhang, Baoping, et al., Mechanical Properties, Degradation Performance and Cytotoxicity of Mg—Zn—Ca Biomedical Alloys with Different Compositions, Materials Science and Engineering C 31 (2011) 1667-1673.
Gunde, P., et al., High-Strength Magnesium Alloys for Degradable Implant Applications, Materials Science and Engineering,A 528 (2011) 1047-1054.
Stefanidou, M. et al., Zinc: A Multipurpose Trace Element, Arch Toxicol (2006) 80: 1-9.
Tapiero, Haim, et al., Trace Elements in Human Physiology and Pathology: Zinc and Metallothioneins, Biomedicine & Pharmacotherapy 57 (2003) 399-411.
Hanzi, A.C., et al., Design Considerations for Achieving Simultaneously High-Strength and Highly Ductile Magnesium Alloys, Philosophical Magazine Letters 2012, 1-11.
Zberg, Bruno, et al, MgZnCa Glasses Without Clinically Observable Hydrogen Evolution for Biodegradable Implants, Nature Materials, vol. 8, Nov. 2009, 887-891.
Staiger, Mark P., et al., Magnesium and its Alloys as Orthopedic Biomaterials: A Review, Biomaterials 27 (2006) 1728-1734.
Witte, Frank, et al., Degradable Biomaterials Based on Magnesium Corrosions, Current Opinion in Solid State and Materials Science (2009).
Zhang, Shaoxiang, et al., Research on an Mg—Zn Alloy as Degradable Biomaterial, Acta Biomaterialia 6 (2010) 626-640.
Song, Guangling, Control of Biodegradation of Biocompatable Magnesium Alloys, Corrosion Science 49 (2007) 1696-1701.
Hofstetter, J., et al., High-Strength Low-Alloy (HSLA) Mg—Zn—Ca Alloys with Excellent Biodegradation Performance, JOM, vol. 66, No. 4, 2014.
Mendis, C.L., et al., An Enhanced Age Hardening Response in Mg—Sn Based Alloys Containing Zn, Materials Science and Engineering A 435-436 (2006) 163-171.
Sudholz, A.D., et al., Corrosion Behaviour of Mg-Alloy AZ91E with Atypical Alloying Additions, Journal of Alloys and Compounds 471 (2009) 109-115.
Chia, T.L., et al., The Effect of Alloy Composition on the Microstructure and Tensile Properties of Binary Mg-rare Earth Alloys, Intermetallics 17 (2009) 481-490.
Birbilis, N., et al., On the Corrosion of Binary Magnesium-Rare Earth Alloys, Corrosion Science 51 (2009) 683-689.
Birbilis, N., et al., A Combined Neural Network and Mechanistic Approach for the Prediction of Corrosion Rate and Yield Strength of Magnesium-Rare Earth Alloys, Corrosion Science 53 (2011) 168-176.
A.D. Sudholz, et al., Electrochemical Properties of Intermetallic Phases and Common Impurity Elements in Magnesium Alloys, Electrochemical and Solid-State Letters, 14 (2) C5-C7 (2011).
Shaw, Barbara, Corrosion Resistance of Magnesium Alloys, ASM Handbook, vol. 13A, 2003,692-696.
K. Oh-Ishi et al., "Age-hardening response of Mg-0.3at.%Ca alloys with different Zn contents", Materials Science and Engineering A, vol. 526, pp. 177-184, 2009.
Yuji Kawamura, Japanese Office Action for corresponding Japanese Application No. 2015-519055, dated Apr. 11, 2018.

* cited by examiner

MAGNESIUM-ZINC-CALCIUM ALLOY AND METHOD FOR PRODUCING IMPLANTS CONTAINING THE SAME

PRIORITY CLAIM

This application is a U.S. National Phase under 35 U.S.C. § 371 of International Application No. PCT/EP2013/063253, filed Jun. 25, 2013, which claims priority to U.S. Provisional Application No. 61/664,224, filed Jun. 26, 2012; to U.S. Provisional Application No. 61/664,229, filed Jun. 26, 2012; to U.S. Provisional Application No. 61/664,274, filed Jun. 26, 2012; and to German application DE 10 2013 201 696.4, filed Feb. 1, 2013.

FIELD OF THE INVENTION

A field of the invention relates to a magnesium alloy and to a method for production thereof and also to the use thereof. Magnesium alloys of the invention are applicable to implants, including cardiovascular, osteosynthesis, and tissue implants. Example applications include stents, valves, closure devices, occluders, clips, coils, staples, implantable regional drug delivery devices, implantable electrostimulators (like pacemakers and defibrillators), implantable monitoring devices, implantable electrodes, systems for fastening and temporarily fixing tissue implants and tissue transplantations. Additional example applications include implantable plates, pins, rods, wires, screws, clips, nails, and staples.

BACKGROUND

Magnesium alloy properties are determined by the type and quantity of the alloy partners and impurity elements and also by the production conditions. Some effects of the alloy partners and impurity elements on the properties of the magnesium alloys are presented in C. KAMMER, Magnesium-Taschenbuch (Magnesium Handbook), p. 156-161, Aluminum Verlag Dusseldorf, 2000 first edition and are illustrate the complexity of determining the properties of binary or ternary magnesium alloys for use thereof as implant material.

The most frequently used alloy element for magnesium is aluminum, which leads to an increase in strength as a result of solid solution hardening and dispersion strengthening and fine grain formation, but also to microporosity. Furthermore, aluminum shifts the participation boundary of the iron in the melt to considerably low iron contents, at which the iron particles precipitate or form intermetallic particles with other elements.

Calcium has a pronounced grain refinement effect and impairs castability.

Undesired accompanying elements in magnesium alloys are iron, nickel, cobalt and copper, which, due to their electropositive nature, cause a considerable increase in the tendency for corrosion.

Manganese is found in all magnesium alloys and binds iron in the form of AlMnFe sediments, such that local element formation is reduced. On the other hand, manganese is unable to bind all iron, and therefore a residue of iron and a residue of manganese always remain in the melt.

Silicon reduces castability and viscosity and, with rising Si content, worsened corrosion behavior has to be anticipated. Iron, manganese and silicon have a very high tendency to form an intermetallic phase. This phase has a very high electrochemical potential and can therefore act as a cathode controlling the corrosion of the alloy matrix.

As a result of solid solution hardening, zinc leads to an improvement in the mechanical properties and to grain refinement, but also to microporosity with tendency for hot crack formation from a content of 1.5-2% by weight in binary Mg/Zn and ternary Mg/Al/Zn alloys.

Alloy additives formed from zirconium increase the tensile strength without lowering the extension and lead to grain refinement, but also to severe impairment of dynamic recrystallization, which manifests itself in an increase of the recrystallization temperature and therefore requires high energy expenditures. In addition, zirconium cannot be added to aluminous and silicious melts because the grain refinement effect is lost.

Rare earths, such as Lu, Er, Ho, Th, Sc and In, all demonstrate similar chemical behavior and, on the magnesium-rich side of the binary phase diagram, form eutectic systems with partial solubility, such that precipitation hardening is possible.

The addition of further alloy elements in conjunction with the impurities leads to the formation of different intermetallic phases in binary magnesium alloys (MARTIENSSSEN, WARLIMONT, Springer Handbook of Condensed Matter and Materials Data, S. 163, Springer Berlin Heidelberg New York, 2005). For example, the intermetallic phase $Mg_{17}Al_{12}$ forming at the grain boundaries is thus brittle and limits the ductility. Compared to the magnesium matrix, this intermetallic phase is more noble and can form local elements, whereby the corrosion behavior deteriorates (NISANCIOGLU, K, is et al, Corrosion mechanism of AZ91 magnesium alloy, Proc. Of 47th World Magnesium Association, London: Institute of Materials, 41-45).

Besides theses influencing factors, the properties of the magnesium alloys are, in addition, also significantly dependent on the metallurgical production conditions. Impurities when alloying together the alloy partners are inevitably introduced by the conventional casting method. The prior art (U.S. Pat. No. 5,055,254 A) therefore predefines tolerance limits for impurities in magnesium alloys, and specifies tolerance limits from 0.0015 to 0.0024% Fe, 0.0010% Ni, 0.0010 to 0.0024% Cu and no less than 0.15 to 0.5 Mn for example for a magnesium/aluminum/zinc alloy with approximately 8 to 9.5% Al and 0.45 to 0.9% Zn. Tolerance limits for impurities in magnesium and alloys thereof are specified in % by HILLIS, MERECER, MURRAY: "Compositional Requirements for Quality Performance with High Purity", Proceedings 55th Meeting of the IMA, Coronado, S.74-81 and SONG, G., ATRENS, A."Corrosion of non-Ferrous Alloys, III. Magnesium-Alloys, S. 131-171 in SCHUTZE M., "Corrosion and Degradation", Wiley-VCH, Weinheim 2000 as well as production conditions as follows:

| Alloy | Production | State | Fe | Fe/Mn | Ni | Cu |
|---|---|---|---|---|---|---|
| pure Mg | not specified | | 0.017 | | 0.005 | 0.01 |
| AZ 91 | pressure die casting | F | | 0.032 | 0.005 | 0.040 |
| | high-pressure die casting | | | 0.032 | 0.005 | 0.040 |
| | low-pressure die casting | | | 0.032 | 0.001 | 0.040 |
| | | T4 | | 0.035 | 0.001 | 0.010 |
| | | T6 | | 0.046 | 0.001 | 0.040 |
| | gravity die casting | F | | 0.032 | 0.001 | 0.040 |
| AM60 | pressure die casting | F | | 0.021 | 0.003 | 0.010 |
| AM50 | pressure die casting | F | | 0.015 | 0.003 | 0.010 |
| AS41 | pressure die casting | F | | 0.010 | 0.004 | 0.020 |
| AE42 | pressure die casting | F | | 0.020 | 0.020 | 0.100 |

It has been found that these tolerance specifications are not sufficient to reliably rule out the formation of corrosion-promoting intermetallic phases, which exhibit a more noble electrochemical potential compared to the magnesium matrix.

The biologically degradable implants presuppose a load-bearing function and therefore strength in conjunction with a sufficient extension capability during its physiologically required support time. The known magnesium materials however fall far short of the strength properties provided by permanent implants, such as titanium, CoCr alloys and titanium alloys. The strength $R_m$ for permanent implants is approximately 500 MPa to >1,000 MPa, whereas by contrast that of the magnesium materials was previously <275 MPa or in most cases <250 MPa.

A further disadvantage of many commercial magnesium materials lies in the fact that they is have only a small difference between the strength $R_m$ and the proof stress $R_p$. In the case of plastically formable implants, for example cardiovascular stents, this means that, once the material starts to deform, no further resistance opposes the deformation and the regions already plastically deformed are deformed further without a rise in load. This can lead to overstretching of parts of the component and fracture may occur.

Many magnesium materials, such as the alloys in the AZ group, also demonstrate a considerably pronounced mechanical asymmetry, which manifests itself in contrast to the mechanical properties, in particular the proof stress $R_p$ under tensile or compressive load. Asymmetries of this type are produced for example during forming processes, such as extrusion, rolling, or drawing, for production of suitable semifinished products. If the difference between the proof stress $R_p$ under tensile load and the proof stress $R_p$ under compressive load is too great, this may lead, in the case of a component that will be subsequently deformed multiaxially, such as a cardiovascular stent, to inhomogeneous deformation with the result of cracking and fracture.

Generally, due to the low number of crystallographic slip systems, magnesium alloys may also form textures during forming processes, such as extrusion, rolling or drawing, for the production of suitable semifinished products as a result of the orientation of the grains during the forming process. More specifically, the semifinished product has different properties in different spatial directions. For example, after the forming process, there is high deformability or elongation at failure in one spatial direction and reduced deformability or elongation at failure in another spatial direction. The formation of such textures is likewise to be avoided, since, in the case of a stent, high plastic deformation is impressed and a reduced elongation at failure increases the risk of implant failure. One method for largely avoiding such textures during forming is the setting of the finest possible grain before the forming process. At room temperature, magnesium materials have only a low deformation capacity characterized by slip in the base plane due to their hexagonal lattice structure. If the material additionally has a coarse microstructure, i.e., a coarse grain, what is known as twin formation will be forced in the event of further deformation, wherein shear strain takes place, which transfers a crystal region into a position axially symmetrical with respect to the starting position.

The twin grain boundaries thus produced constitute weak points in the material, at which, specifically in the event of plastic deformation, crack initiation starts and ultimately leads to destruction of the component.

If implant materials have a sufficiently fine grain, the risk of such an implant failure is then highly reduced. Implant materials should therefore have the finest possible grain so as to avoid an undesired shear strain of this type.

All available commercial magnesium materials for implants are subject to severe corrosive attack in physiological media. The prior art attempts to confine the tendency for corrosion by providing the implants with an anti-corrosion coating, for example formed from polymeric substances (EP 2 085 100 A2, EP 2 384 725 A1), an aqueous or alcoholic conversion solution (DE 10 2006 060 501 A1), or an oxide (DE 10 2010 027 532 A1, EP 0 295 397 A1).

The use of polymeric passivation layers is controversial, since practically all corresponding polymers sometimes also produce high levels of inflammation in the tissue. On the other hand, structures without protective measures of this type do not achieve the necessary support times. The corrosion at thin-walled traumatological implants often accompanies an excessively quick loss of strength, which is additionally encumbered by the formation of an excessively large amount of hydrogen per unit of time. This results in undesirable gas enclosures in the bones and tissue.

In the case of traumatological implants having relatively large cross sections, there is a need to selectively control the hydrogen problem and the corrosion rate of the implant over its structure.

Specifically in the case of biologically degradable implants, there is a desire for maximum body-compatibility of the elements, since, during degradation, all contained chemical elements are received by the body. Here, highly toxic elements, such as Be, Cd, Pb, Cr and the like, should be avoided in any case.

Degradable magnesium alloys are particularly suitable for producing implants that have been used in a wide range of embodiments in modern medical engineering. For example, implants are used to support vessels, hollow organs and vein systems (endovascular implants, for example stents), to fasten and temporarily fix tissue implants and tissue transplants, but also for orthopedic purposes, for example as pins, plates or screws. A particularly frequently used form of an implant is the stent.

In particular, the implantation of stents has become established as one of the most effective therapeutic measures in the treatment of vascular diseases. Stents are used to perform a supporting function in a patient's hollow organs. For this purpose, stents of conventional design have a filigree supporting structure formed from metal struts, which is initially provided in a compressed form for insertion into the body and is expanded at the site of application. One of the main fields of application of such stents is the permanent or temporary widening and maintained opening of vascular constrictions, in particular of constrictions (stenoses) of the coronary vessels. In addition, aneurysm stents are also known for example, which are used primarily to seal the aneurysm. The supporting function is provided in addition.

A stent has a main body formed from an implant material. An implant material is a non-living material, which is used for an application in the field of medicine and interacts with biological systems. Basic preconditions for the use of a material as implant material that comes into contact with the bodily environment when used as intended is its compatibility with the body (biocompatibility). Biocompatibility is understood to mean the ability of a material to induce a suitable tissue response in a specific application. This includes an adaptation of the chemical, physical, biological and morphological surface properties of an implant to the receiver tissue with the objective of a clinically desired interaction. The biocompatibility of the implant material is also dependent on the progression over time of the response of the biosystem into which the material has been implanted. Relatively short-term irritation and inflammation thus occur and may lead to tissue changes. Biological systems therefore respond differently according to the properties of the implant material. The implant materials can be divided into bioactive, bioinert and degradable/resorbable materials in accordance with the response of the biosystem.

Conventional implant materials include polymers, metal materials and ceramic materials (for example as a coating). Biocompatible metals and metal alloys for permanent implants include stainless steels for example (such as 316L), cobalt-based alloys (such as CoCrMo cast alloys, CoCrMo forged alloys, CoCrWNi forged alloys and CoCrNiMo forged alloys), pure titanium and titanium alloys (for example cp titanium, TiAl6V4 or TiAl6Nb7) and gold alloys. In the field of biocorrodible stents, the use of magnesium or pure iron as well as biocorrodible master alloys of the elements magnesium, iron, zinc, molybdenum and tungsten is recommended.

The use of biocorrodible magnesium alloys for temporary implants having filigree structures is in particular hindered by the fact that the implant degrades very rapidly in vivo. Various approaches are under discussion for reducing the corrosion rate, that is to say the degradation rate. Modified alloys and coatings represent categories of approaches to reduce the corrosion rate of magnesium alloys. Modified allows are produced to slow down the degradation on the part of the implant material as a result of suitable alloy development. Coatings are used to temporarily inhibit the degradation. Some approaches were very promising, but it has not yet been possible to produce a commercially obtainable product to the knowledge of the inventors. Rather, irrespective of the previous efforts, there is still an ongoing need for solution approaches that enable at least temporary reduction of the in vivo corrosion with simultaneous optimization of the mechanical properties of magnesium alloys.

SUMMARY OF THE INVENTION

Preferred embodiments of the invention provide a biologically degradable magnesium alloy and a method for production thereof, which make it possible to keep the magnesium matrix of the implant in an electrochemically stable state over the necessary support time with fine grain and high corrosion resistance without protective layers and to utilize the formation of intermetallic phases that are electrochemically less noble compared to the magnesium matrix with simultaneous improvement of the mechanical properties, such as the increase in strength and proof stress as well as the reduction of the mechanical asymmetry, to set the degradation rate of the implants.

A preferred magnesium alloy includes no more than 3.0% by weight of Zn, no more than 0.6% by weight of Ca, with the rest being formed by magnesium containing impurities, which favor electrochemical potential differences and/or promote the formation of intermetallic phases, in a total amount of no more than 0.005% by weight of Fe, Si, Mn, Co, Ni, Cu, Al, Zr and P, wherein the alloy contains elements selected from the group of rare earths with the atomic number 21, 39, 57 to 71 and 89 to 103 in a total amount of no more than 0.002% by weight.

A preferred method produces a magnesium alloy having improved mechanical and electrochemical properties. The method includes producing a highly pure magnesium by vacuum distillation. A cast billet of the alloy is produced by synthesis of the highly pure magnesium with a composition, wherein the alloy includes no more than 3.0% by weight of Zn, no more than 0.6% by weight of Ca, with the rest being formed by magnesium containing impurities, which favor electrochemical potential differences and/or promote the formation of intermetallic phases, in a total amount of no more than 0.005% by weight of Fe, Si, Mn, Co, Ni, Cu, Al, Zr and P, wherein the alloy contains elements selected from the group of rare earths with the atomic number 21, 39, 57 to 71 and 89 to 103 in a total amount of no more than 0.002% by weight. The alloy is homogenized bringing the alloy constituents into complete solution by annealing in one or more annealing steps at one or more successively increasing temperatures between 300° C. and 450° C. with a holding period of 0.5 h to 40 h in each case. The homogenized alloy is optionally aged between 100 and 450° C. for 0.5 h to 20 h. The homogenized alloy is formed in a temperature range between 150° C. and 375° C. The formed homogenized alloy is optionally aged between 100 and 450° C. for 0.5 h to 20 h. A heat treatment of the formed alloy can be carried out in the temperature range between 100° C. and 325° C. with a holding period from 1 min to 10 h.

DETAILED DESCRIPTION OF THE PREFERRED EMBODIMENTS

The magnesium alloy according to the invention has an extraordinarily high resistance to corrosion, which is achieved as a result of the fact that the fractions of the impurity elements and the combination thereof in the magnesium matrix are extraordinarily reduced and at the same time precipitation-hardenable and solid-solution-hardenable elements are to be added, said alloy, after thermomechanical treatment, having such electrochemical potential differences between the matrix in the precipitated phases that the precipitated phases do not accelerate corrosion of the matrix in physiological media or slow down the corrosion. The solution according to the invention is based on the awareness of ensuring resistance to corrosion and resistance to stress corrosion and vibration corrosion of the magnesium matrix of the implant over the support period, such that the implant is able to withstand ongoing multi-axial stress without fracture or cracking, and simultaneously to use the magnesium matrix as a store for the degradation initiated by the physiological fluids.

Applicant has surprisingly found that:

First, the alloy contains an intermetallic phase $Ca_2Mg_6Zn_3$ and/or $Mg_2Ca$ in a volume fraction of close to 0 to 2.0% and the phase MgZn is avoided, if the content of Zn is preferably 0.1 to 2.5% by weight, particularly preferably 0.1 to 1.6% by weight, and the content of Ca is no more than 0.5% by weight, more preferably 0.001 to 0.5% by weight, and particularly preferably at least 0.1 to 0.45% by weight.

Second, compared to the conventional alloy matrices, intermetallic phases $Mg_2Ca$ and $Ca_2Mg_6Zn_3$, in particular in each case in a volume fraction of at most 2%, are primarily formed, if the alloy matrix contains 0.1 to 0.3% by weight of Zn and also 0.2 to 0.6% by weight of Ca and/or a ratio of the content of Zn to the content of Ca no more than 20, preferably no more than 10, more preferably no more than 3 and particularly preferably no more than 1.

The alloy matrix has an increasingly positive electrode potential with respect to the intermetallic phase $Ca_2Mg_6Zn_3$ and with respect to the intermetallic phase $Mg_2Ca$, which means that the intermetallic phase $Mg_2Ca$ is less noble in relation to the intermetallic phase $Ca_2Mg_6Zn_3$ and both intermetallic phases are simultaneously less noble with respect to the alloy matrix. The two phases $Mg_2Ca$ and $Ca_2Mg_6Zn_3$ are therefore at least as noble as the matrix phase or are less noble than the matrix phase in accordance with the subject matter of the present patent application. Both intermetallic phases are brought to precipitation in the desired scope as a result of a suitable heat treatment before, during and after the forming process in a regime defined by the temperature and the holding period, whereby the degradation rate of the alloy matrix can be set. As a result of this regime, the precipitation of the intermetallic phase MgZn can also be avoided practically completely. The last-mentioned phase is therefore to be avoided in accordance with the subject matter of this patent application, since it has a more positive potential compared to the alloy matrix, that is to say is much more noble compared to the alloy matrix, that is to say it acts in a cathodic manner. This leads undesirably to the fact that the anodic reaction, that is to say the corrosive dissolution of a component of the material, takes place at the material matrix, which leads to destruction of the cohesion of the matrix and therefore to destruction of the component. This destruction therefore also progresses continuously, because particles that are more noble are continuously exposed by the corrosion of the matrix and the corrosive attack never slows, down, but is generally accelerated further as a result of the enlargement of the cathode area.

In the case of the precipitation of particles which are less noble than the matrix, that is to say have a more negative electrochemical potential than the matrix, it is not the material matrix that is corrosively dissolved, but the particles themselves. This dissolution of the particles in turn leaves behind a substantially electrochemically homogenous surface of the matrix material, which, due to this lack of electrochemical inhomogeneities, already has a much lower tendency for corrosion and, specifically also due to the use of highly pure materials, itself has yet greater resistance to corrosion.

A further surprising result is that, in spite of Zr freedom or Zr contents much lower than those specified in the prior art, a grain refinement effect can be achieved that is attributed to the intermetallic phases $Ca_2Mg_6Zn_3$ and/or $Mg_2Ca$, which block movement of the grain boundaries, delimit the grain size during recrystallization, and thereby avoid an undesirable grain growth, wherein the values for the yield points and strength are simultaneously increased.

A reduction of the Zr content is therefore also particularly desirable because the dynamic recrystallization of magnesium alloys is suppressed by Zr. This result in the fact that alloys containing Zr have to be fed more and more energy during or after a forming process than alloys free from Zr in order to achieve complete recrystallization. A higher energy feed in turn signifies higher forming temperatures and a greater risk of uncontrolled grain growth during the heat treatment. This is avoided in the case of the Mg/Zn/Ca alloys free from Zr described here.

Within the context of the above-mentioned mechanical properties, a Zr content of no more than 0.0003% by weight, preferably no more than 0.0001% by weight, is therefore advantageous for the magnesium alloy according to the invention.

The previously known tolerance limits for impurities do not take into account the fact that magnesium wrought alloys are in many cases subject to a thermomechanical treatment, in particular a relatively long annealing process, as a result of which structures close to equilibrium structures are produced. Here, the metal elements interconnect as a result of diffusion and form what are known as intermetallic phases, which have a different electrochemical potential, in particular a much greater potential, compared to the magnesium matrix, whereby these phases act as cathodes and can trigger galvanic corrosion processes.

The applicant has found that, if the following tolerance limits of individual impurities are observed, the formation of intermetallic phases of this type is reliably no longer to be expected:

Fe≤0.0005% by weight,
Si≤0.0005% by weight,
Mn≤0.0005% by weight,
Co≤0.0002% by weight, preferably ≤0.0001% by weight,
Ni≤0.0002% by weight, preferably ≤0.0001% by weight,
Cu≤0.0002% by weight,
Al≤0.001% by weight,
Zr≤0.0003% by weight, preferably ≤0.0001
P≤0.0001% by weight, preferably ≤0.00005.

With a combination of the impurity elements, the formation of the intermetallic phases more noble than the alloy matrix then ceases if the sum of the individual impurities of Fe, Si, Mn, Co, Ni, Cu and Al is no more than 0.004% by weight, preferably no more than 0.0032% by weight, even more preferably no more than 0.002% by weight and particularly preferably no more than 0.001% by weight, the content of Al is no more than 0.001% by weight, and the content of Zr is preferably no more than 0.0003% by weight, preferably no more than 0.0001% by weight.

The active mechanisms by which the aforementioned impurities impair the resistance to corrosion of the material are different.

If small Fe particles form in the alloy as a result of an excessively high Fe content, these particles act as cathodes for corrosive attack; the same is true for Ni and Cu.

Furthermore, Fe and Ni with Zr in particular, but also Fe, Ni and Cu with Zr can also precipitate as intermetallic particles in the melt; these also act as very effective cathodes for the corrosion of the matrix.

Intermetallic particles with a very high potential difference compared to the matrix and a very high tendency for formation are the phases formed from Fe and Si and also from Fe, Mn and Si, which is why contaminations with these elements also have to be kept as low as possible.

P contents should be reduced as far as possible, since, even with minimal quantities, Mg phosphides form and very severely impair the mechanical properties of the structure.

Such low concentrations therefore ensure that the magnesium matrix no longer has any intermetallic phases having a more positive electrochemical potential compared to the matrix.

In the magnesium alloy according to the invention, the individual elements from the group of rare earths and scandium (atomic number 21, 39, 57 to 71 and 89 to 103) contribute no more than 0.001% by weight, preferably no more than 0.0003% by weight and particularly preferably no more than 0.0001% by weight, to the total amount.

These additives make it possible to increase the strength of the magnesium matrix and to increase the electrochemical potential of the matrix, whereby an effect that reduces corrosion, in particular with respect to physiological media, is set.

The precipitations preferably have a size of no more than 2.0 μm, preferably of no more than 1.0 μm, particularly preferably no more than 200 nm, distributed dispersely at the grain boundaries or inside the grain.

For applications in which the materials are subject to plastic deformation and in which high ductility and possibly also a low ratio yield point (low ratio yield point=yield point/tensile strength)–that is to say high hardening–is desirable, a size of the precipitates between 100 nm and 1 μm, preferably between 200 nm and 1 μm, is particularly preferred. For example, this concerns vascular implants, in particular stents.

For applications in which the materials are subject to no plastic deformation or only very low plastic deformation, the size of the precipitates is preferably no more than 200 nm. This is the case for example with orthopedic implants, such as screws for osteosynthesis implants. The precipitates may particularly preferably have a size, below the aforementioned preferred range, of no more than 50 nm and still more preferably no more than 20 nm.

Here, the precipitates are dispersely distributed at the grain boundaries and inside the grain, whereby the movement of grain boundaries in the event of a thermal or thermomechanical treatment and also displacements in the event of deformation are hindered and the strength of the magnesium alloy is increased.

The magnesium alloy according to the invention achieves a strength of >275 MPa, preferably >300 MPa, a yield point of >200 MPa, preferably >225 MPa, and a ratio yield point of <0.8, preferably <0.75, wherein the difference between strength and yield point is >50 MPa, preferably >100 MPa, and the mechanical asymmetry is <1.25.

These significantly improved mechanical properties of the new magnesium alloys ensure that the implants, for example cardiovascular stents, withstand the ongoing multi-axial load in the implanted state over the entire support period, in spite of initiation of the degradation of the magnesium matrix as a result of corrosion.

For minimization of the mechanical asymmetry, it is of particular importance for the magnesium alloy to have a particularly fine microstructure with a grain size of no more than 5.0 μm, preferably no more than 3.0 μm, and particularly preferably no more than 1.0 μm without considerable electrochemical potential differences compared to the matrix phases.

A preferred method for producing a magnesium alloy having improved mechanical and electrochemical properties. The method comprises the following steps a) producing a highly pure magnesium by vacuum distillation;

b) producing a cast billet of the alloy as a result of synthesis of the magnesium according to step a) with highly pure Zn and Ca in a composition of no more than 3.0% by weight of Zn, no more than 0.6% by weight of Ca, with the rest being formed by magnesium containing impurities, which favor electrochemical potential differences and/or promote the formation of intermetallic phases, in a total amount of no more than 0.005% by weight of Fe, Si, Mn, Co, Ni, Cu, Al, Zr and P, wherein the alloy contains elements selected from the group of rare earths with the atomic number 21, 39, 57 to 71 and 89 to 103 in a total amount of no more than 0.002% by weight;

c) homogenizing the alloy at least once and, in so doing, bringing the alloy constituents into complete solution by annealing in one or more annealing steps at one or more successively increasing temperatures between 300° C. and 450° C. with a holding period of 0.5 h to 40 h in each case;

d) optionally ageing the homogenized alloy between 100 and 450° C. for 0.5 h to 20 h;

e) forming the homogenized alloy at least once in a simple manner in a temperature range between 150° C. and 375° C.;

f) optionally ageing the homogenized alloy between 100 and 450° C. for 0.5 h to 20 h;

g) selectively carrying out a heat treatment of the formed alloy in the temperature range between 100° C. and 325° C. with a holding period from 1 min to 10 h, preferred from 1 min to 6 h, still more preferred from 1 min to 3 h.

A content of from 0.1 to 0.3% by weight of Zn and from 0.2 to 0.4% by weight of Ca and/or a ratio of Zn to Ca of no more than 20, preferably of no more than 10 and particularly preferably of no more than 3 ensures that a volume fraction of at most up to 2% of the intermetallic phase and of the separable phases $Ca_2Mg_6Zn_3$ and $Mg_2Ca$ are produced in the matrix lattice. The electrochemical potential of both phases differs considerably, wherein the phase $Ca_2Mg_6Zn_3$ generally has a more positive electrode potential than the phase $Mg_2Ca$. Furthermore the electrochemical potential of the $Ca_2Mg_6Zn_3$ phase is almost equal compared to the matrix phase, because in alloy systems, in which only the phase $Ca_2Mg_6Zn_3$ is precipitated in the matrix phase, no visible corrosive attack takes place. The $Ca_2Mg_6Zn_3$ and/or $Mg_2Ca$ phases can be brought to precipitation in the desired scope before, during and/or after the forming in step e)—in particular alternatively or additionally during the ageing process—in a regime preselected by the temperature and the holding period, whereby the degradation rate of the alloy matrix can be set. As a result of this regime, the precipitation of the intermetallic phase MgZn can also be avoided practically completely.

This regime is determined in particular in its minimum value T by the following formula:

$$T>(40\times(\%\ Zn)+50))(\text{in. } ^\circ\ C.)$$

The aforementioned formula is used to calculate the upper limit value determined by the Zn content of the alloy, wherein the following boundary conditions apply however;

for the upper limit value of the ageing temperature in method step d) and/or f), the following is true for T: 100° C.≤T≤450° C., preferably T: 100° C.≤T≤350° C., still more preferred 100° C.≤T≤275° C.

in the case of the maximum temperature during the at least one forming step in method step e), the following is true for T: 150° C.≤T≤375° C.

in the case of the above-mentioned heat treatment step in method step g), the following is true for T: 100° C.≤T≤325° C.

Specifically, for the production of alloy matrices with low Zn content, attention may have to be paid, in contrast to the specified formula, to ensure that the aforementioned minimum temperatures are observed, since, if said temperatures are not met, the necessary diffusion processes cannot take place in commercially realistic times, or, in the case of method step e), impractical low forming temperatures may be established.

The upper limit of the temperature T in method step d) and/or f) ensures that a sufficient number of small, finely distributed particles not growing too excessively as a result of coagulation is present before the forming step.

The upper limit of the temperature T in method step e) ensures that a sufficient spacing from the temperatures at which the material melts is observed. In addition, the amount of heat produced during the forming process and likewise fed to the material should also be monitored in this case.

The upper limit of the temperature T in method step g) in turn ensures that a sufficient volume fraction of particles is obtained, and, as a result of the high temperatures, that a fraction of the alloy elements that is not too high is brought into solution. Furthermore, as a result of this limitation of the temperature T, it is to be ensured that the volume fraction of the produced particles is too low to cause an effective increase in strength.

The intermetallic phases $Ca_2Mg_6Zn_3$ and $Mg_2Ca$, besides their anti-corrosion effect, also have the surprising effect of a grain refinement, produced by the forming process, which leads to a significant increase in the strength and proof stress. It is thus possible to dispense with Zr particles or particles containing Zr as an alloy element and to reduce the temperatures for recrystallization.

The vacuum distillation is preferably capable of producing a starting material for a highly pure magnesium/zinc/calcium alloy with the stipulated limit values.

The total amount of impurities and the content of the additive elements triggering the precipitation hardening and solid solution hardening and also increasing the matrix potential can be set selectively and are presented in % by weight:

a) for the individual impurities:

Fe≤0.0005; Si≤0.0005; Mn≤0.0005; Co≤0.0002, preferably ≤0.0001% by weight; Ni ≤0.0002, preferably ≤0.0001; Cu≤0.0002; Al≤0.001; Zr≤0.0003, in particular preferably ≤0.0001; P≤0.0001, in particular preferably ≤0.00005;

b) for the combination of individual impurities in total:

Fe, Si, Mn, Co, Ni, Cu and Al no more than 0.004%, preferably no more than 0.0032% by weight, more preferably no more than 0.002% by weight and particularly preferably 0.001, the content of Al no more than 0.001, and the content of Zr preferably no more than 0.0003, in particular preferably no more than 0.0001;

c) for the additive elements:

rare earths in a total amount of no more than 0.001 and the individual additive elements in each case no more than 0.0003, preferably 0.0001.

It is particularly advantageous that the method according to the invention has a low number of forming steps. Extrusion, co-channel angle pressing and/or also a multiple forging can thus preferably be used, which ensure that a largely homogeneously fine grain of no more than 5.0 μm, preferably no more than 3.0 μm and particularly preferably no more than 1.0 μm, is achieved.

As a result of the heat treatment, $Ca_2Mg_6Zn_3$ and/or $Mg_2Ca$ precipitates form, of which the size may be up to a few μm. As a result of suitable process conditions during the production process by means of casting and the forming processes, it is possible however to achieve intermetallic particles having a size between no more than 2.0 μm, and preferably no more than 1.0 μm particularly preferably no more than 200 nm.

The precipitates in the fine-grain structure are dispersely distributed at the grain boundaries and inside the grains, whereby the strength of the alloy reaches values that, at >275 MPa, preferably >300 MPa, are much greater than those in the prior art.

The $Ca_2Mg_6Zn_3$ and/or $Mg_2Ca$ precipitates are present within this fine-grain structure in a size of no more than 2.0 μm, preferably no more than 1.0 μm.

A size of the precipitates between 100 nm and 1.0 μm, preferably between 200 nm and 1.0 μm, are particularly preferred for applications in which the materials are subject to plastic deformation and in which high ductility and possibly also a low ratio yield point (low ratio yield point=yield point/tensile strength)—that is to say high hardening—is desired. For example, this concerns vascular implants, in particular stents.

Preferably for applications in which the materials are subject to no plastic deformation or only very low plastic deformation, the size of the precipitates is no more than 200 nm. This the case for example with orthopedic implants, such as screws for osteosynthesis implants. The precipitates may particularly preferably have a size, below the aforementioned preferred range, of no more than 50 nm and most preferably no more than 20 nm.

The invention also concerns the use of the magnesium alloy produced by the method and having the above-described advantageous composition and structure in medical engineering, in particular for the production of implants, for example endovascular implants such as stents, for fastening and temporarily fixing tissue implants and tissue transplants, orthopedic implants, dental implants and neuro implants.

Exemplary Embodiments

The starting material of the following exemplary embodiments is in each case a highly pure Mg alloy, which has been produced by means of a vacuum distillation method. Examples for such a vacuum distillation method are disclosed in the Canadian patent application "process and apparatus for vacuum distillation of high-purity magnesium" having application number CA2860978 (A1), and corresponding U.S. application Ser. No. 14/370,186, which is incorporated within its full scope into the present disclosure.

EXAMPLE 1

A magnesium alloy having the composition 1.5% by weight of Zn and 0.25% by weight of Ca, with the rest being formed by Mg with the following individual impurities in % by weight is produced:

Fe: <0.0005; Si: <0.0005; Mn: <0.0005; Co: <0.0002; Ni: <0.0002; Cu<0.0002, wherein the sum of impurities of Fe, Si, Mn, Co, Ni, Cu and Al is to be no more than 0.0015% by weight, the content of Al is to be <0.001% by weight and the content of Zr is to be <0.0003% by weight, and the content of rare earths with the atomic number 21, 39, 57 to 71 and 89 to 103 in total is to be less than 0.001% by weight.

A highly pure magnesium is initially produced by means of a vacuum distillation method; highly pure Mg alloy is then produced by additionally alloying, by means of melting, components Zn and Ca, which are likewise highly pure.

This alloy, in solution, is subjected to homogenization annealing at a temperature of 400° C. for a period of 1 h and then aged for 4 h at 200° C. The material is then subjected to multiple extrusion at a temperature of 250 to 300° C. in order to produce a precision tube for a cardio vascular stent.

EXAMPLE 2

A further magnesium alloy having the composition 0.3% by weight of Zn and 0.35% by weight of Ca, with the rest being formed by Mg with the following individual impurities in % by weight is produced:

Fe: <0.0005; Si: <0.0005; Mn: <0.0005; Co: <0.0002; Ni: <0.0002; Cu<0.0002, wherein the sum of impurities of Fe, Si, Mn, Co, Ni, Cu and Al is to be no more than 0.0015% by weight, the content of Al is to be <0.001% by weight, and the content of Zr is to be <0.0003% by weight, the content of rare earths with the atomic number 21, 39, 57 to 71 and 89 to 103 in total is to be less than 0.001% by weight.

A highly pure magnesium is initially produced by means of a vacuum distillation method; highly pure Mg alloy is then produced by additionally alloying, by means of melting, components Zn and Ca, which are likewise highly pure.

This alloy, in solution, is subjected to homogenization annealing at a temperature of 350° C. for a period of 6 h and in a second step at a temperature of 450° C. for 12 h and is then subjected to multiple extrusion at a temperature of 275 to 350° C. in order to produce a precision tube for a cardiovascular stent.

Hardness-increasing $Mg_2Ca$ particles can be precipitated in intermediate ageing treatments; these annealing can take place at a temperature from 180 to 210° C. for 6 to 12 hours and leads to an additional particle hardening as a result of the precipitation of a further family of $Mg_2Ca$ particles.

As a result of this exemplary method, the grain size can be set to <5.0 μm or <1 μm after adjustment of the parameters.

The magnesium alloy reached a strength level of 290-310 MPa and a 0.2% proof stress of ≤250 MPa.

EXAMPLE 3

A further magnesium alloy having the composition 2.0% by weight of Zn and 0.1% by weight of Ca, with the rest being formed by Mg with the following individual impurities in % by weight is produced:

Fe: <0.0005; Si: <0.0005; Mn: <0.0005; Co: <0.0002; Ni: <0.0002; Cu<0.0002, wherein the sum of impurities of Fe, Si, Mn, Co, Ni, Cu and Al is to be no more than 0.0015% by weight, the content of Al is to be <0.001% by weight and the content of Zr is to be <0.0003% by weight, the content of rare earths with the atomic number 21, 39, 57 to 71 and 89 to 103 in total is to be less than 0.001% by weight.

A highly pure magnesium is initially produced by means of a vacuum distillation method; highly pure Mg alloy is then produced by additionally alloying, by means of melting, components Zn and Ca, which are likewise highly pure.

This alloy, in solution, is subjected to a first homogenization annealing process at a temperature of 350° C. for a period of 20 h and is then subjected to a second homogenization annealing process at a temperature of 400° C. for a period of 6 h, and is then subjected to multiple extrusion at a temperature from 250 to 350° C. to produce a precision tube for a cardiovascular stent Annealing then takes place at a temperature from 250 to 300° C. for 5 to 10 min. Metallic phases $Ca_2Mg_6Zn_3$ are predominantly precipitated out as a result of this process from various heat treatments.

The grain size can be set to <3.0 μm as a result of this method.

The magnesium alloy achieved a strength level of 290-340 MPa and a 0.2% proof stress of 270 MPa.

EXAMPLE 4

A further magnesium alloy having the composition 1.0% by weight of Zn and 0.3% by weight of Ca, with the rest being formed by Mg with the following individual impurities in % by weight is produced:

Fe: <0.0005; Si: <0.0005; Mn: <0.0005; Co: <0.0002; Ni: <0.0002; Cu<0.0002, wherein the sum of impurities of Fe, Si, Mn, Co, Ni, Cu and Al is to be no more than 0.0015% by weight, the content of Al is to be <0.001% by weight and the content of Zr is to be <0.0003% by weight, the content of rare earths with the atomic number 21, 39, 57 to 71 and 89 to 103 in total is to be less than 0.001% by weight.

A highly pure magnesium is initially produced by means of a vacuum distillation method; highly pure Mg alloy is then produced by additionally alloying, by means of melting, components Zn and Ca, which are likewise highly pure.

This alloy, in solution, is subjected to a first homogenization annealing process at a temperature of 350° C. for a period of 20 h and is then subjected to a second homogenization annealing process at a temperature of 400° C. for a period of 10 h, and is then subjected to multiple extrusion at a temperature from 270 to 350° C. to produce a precision tube for a cardio vascular stent. Alternatively to these steps, ageing at approximately at 250° C. with a holding period of 2 hours can take place after the second homogenization annealing process and before the forming process. In addition, an annealing process at a temperature of 325° C. can take place for 5 to 10 min as a completion process after the forming process. As a result of these processes, in particular as a result of the heat regime during the extrusion process, both the phase $Ca_2Mg_6Zn_3$ and also the phase $Mg_2Ca$ can be precipitated.

The grain size can be set to <2.0 μm as a result of this method.

The magnesium alloy achieved a strength level of 350-370 MPa and 0.2% proof stress of 285 MPa.

EXAMPLE 5

A further magnesium alloy having the composition 0.2% by weight of Zn and 0.3% by weight of Ca, with the rest being formed by Mg with the following individual impurities in % by weight is produced:

Fe: <0.0005; Si: <0.0005; Mn: <0.0005; Co: <0.0002; Ni: <0.0002; Cu<0.0002, wherein the sum of impurities of Fe, Si, Mn, Co, Ni, Cu and Al is to be no more than 0.0015% by weight, the content of Al is to be <0.001% by weight and the content of Zr is to be <0.0003% by weight, the content of rare earths with the atomic number 21, 39, 57 to 71 and 89 to 103 in total is to be less than 0.001% by weight.

A highly pure magnesium is initially produced by means of a vacuum distillation method; highly pure Mg alloy is then produced by additionally alloying, by means of melting, components Zn and Ca, which are likewise highly pure.

This alloy, in solution, is subjected to a first homogenization annealing process at a temperature of 350° C. for a period of 20 h and is then subjected to a second homogenization annealing process at a temperature of 400° C. for a period of 10 h, and is then subjected to multiple extrusion at a temperature from 225 to 375° C. to produce a precision tube for a cardio vascular stent. Alternatively to these steps, ageing at approximately at 200 to 275° C. with a holding period of 1 to 6 hours can take place after the second homogenization annealing process and before the forming process. In addition, an annealing process at a temperature of 325° C. can take place for 5 to 10 min as a completion process after the forming process. As a result of these processes, in particular as a result of the heat regime during the extrusion process the phase $Mg_2Ca$ can be precipitated.

The grain size can be set to <2.0 μm as a result of this method.

The magnesium alloy achieved a strength level of 300-345 MPa and 0.2% proof stress of 275 MPa.

EXAMPLE 6

A further magnesium alloy having the composition 0.1% by weight of Zn and 0.25% by weight of Ca, with the rest being formed by Mg with the following individual impurities in % by weight is produced:

Fe: <0.0005; Si: <0.0005; Mn: <0.0005; Co: <0.0002; Ni: <0.0002; Cu<0.0002, wherein the sum of impurities of Fe, Si, Mn, Co, Ni, Cu and Al is to be no more than 0.0015% by weight, the content of Al is to be <0.001% by weight and the content of Zr is to be <0.0003% by weight, the content of rare earths with the atomic number 21, 39, 57 to 71 and 89 to 103 in total is to be less than 0.001% by weight.

A highly pure magnesium is initially produced by means of a vacuum distillation method; highly pure Mg alloy is then produced by additionally alloying, by means of melting, components Zn and Ca, which are likewise highly pure.

This alloy, in solution, is subjected to a first homogenization annealing process at a temperature of 350° C. for a period of 12 h and is then subjected to a second homogenization annealing process at a temperature of 450° C. for a period of 10 h, and is then subjected to multiple extrusion at a temperature from 300 to 375° C. to produce a precision tube for a cardio vascular stent. Alternatively to these steps, ageing at approximately at 200 to 250° C. with a holding period of 2 to 10 hours can take place after the second homogenization annealing process and before the forming process. In addition, an annealing process at a temperature of 325° C. can take place for 5 to 10 min as a completion process after the forming process. As a result of these processes, in particular as a result of the heat regime during the extrusion process, both the phase $Ca_2Mg_6Zn_3$ and also the phase $Mg_2Ca$ can be precipitated out.

The grain size can be set to <2.0 μm as a result of this method.

The magnesium alloy achieved a strength level of 300-345 MPa and 0.2% proof stress of ≤275 MPa.

EXAMPLE 7

A further magnesium alloy having the composition 0.3% by weight of Ca and the rest being formed by Mg with the following individual impurities in % by weight is produced: Fe: <0.0005; Si: <0.0005; Mn: <0.0005; Co: <0.0002; Ni: <0.0002; Cu<0.0002, wherein the sum of impurities of Fe, Si, Mn, Co, Ni, Cu and Al is to be no more than 0.0015% by weight, the content of Al is to be <0.001% by weight and the content of Zr is to be <0.0003% by weight, the content of rare earths with the atomic number 21, 39, 57 to 71 and 89 to 103 in total is to be less than 0.001% by weight.

A highly pure magnesium is initially produced by means of a vacuum distillation method; highly pure Mg alloy is then produced by additionally alloying, by means of melting, components Zn and Ca, which are likewise highly pure.

This alloy, in solution, is subjected to a first homogenization annealing process at a temperature of 350° C. for a period of 15 h and is then subjected to a second homogenization annealing process at a temperature of 450° C. for a period of 10 h, and is then subjected to multiple extrusion at a temperature from 250 to 350° C. to produce a precision tube for a cardio vascular stent. Alternatively to these steps, ageing at approximately at 150 to 250° C. with a holding period of 1 to 20 hours can take place after the second homogenization annealing process and before the forming process. In addition, an annealing process at a temperature of 325° C. can take place for 5 to 10 min as a completion process after the forming process.

As a result of these processes, in particular as a result of the heat regime during the extrusion process, the phase $Mg_2Ca$ can be precipitated being less noble than the matix and thereby providing anodic corrosion protection of the matix.

The grain size can be set to <2.0 μm as a result of this method.

The magnesium alloy achieved a strength level of >340 MPa and 0.2% proof stress of 275 MPa.

EXAMPLE 8

A further magnesium alloy having the composition 0.2% by weight of Zn and 0.5% by weight of Ca, with the rest being formed by Mg with the following individual impurities in % by weight is produced:

Fe: <0.0005; Si: <0.0005; Mn: <0.0005; Co: <0.0002; Ni: <0.0002; Cu<0.0002, wherein the sum of impurities of Fe, Si, Mn, Co, Ni, Cu and Al is to be no more than 0.0015% by weight, the content of Al is to be <0.001% by weight and the content of Zr is to be <0.0003% by weight, the content of rare earths with the atomic number 21, 39, 57 to 71 and 89 to 103 in total is to be less than 0.001% by weight.

A highly pure magnesium is initially produced by means of a vacuum distillation method; highly pure Mg alloy is then produced by additionally alloying, by means of melting, components Zn and Ca, which are likewise highly pure.

This alloy, in solution, is subjected to a first homogenization annealing process at a temperature of 360° C. for a period of 20 h and is then subjected to a second homogenization annealing process at a temperature of 425° C. for a period of 6 h, and is then subjected to an extrusion process at 335° C. to produce a rod with 8 mm diameter that has been subsequently aged at 200 to 250° C. with a holding period of 2 to 10 hours for production of screws for craniofacial fixations. The grain size achieved was <2.0 μm as a result of this method. The magnesium alloy achieved a strength of >375 MPa and proof stress of <300 MPa.

The 8 mm diameter rod was also subjected to a wire drawing process to produce wires for fixation of bone fractures. Wires were subjected to an annealing at 250° C. for 15 min. The grain size achieved was <2.0 μm as a result of this method. The magnesium alloy achieved a strength level of >280 MPa and 0.2% proof stress of 190 MPa.

While specific embodiments of the present invention have been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

Various features of the invention are set forth in the appended claims.

The invention claimed is:

1. A biodegradable implant comprising:

a magensium alloy having improved mechanical and electromechanical properties, comprising 0.1 to 1.6% by weight of Zn, 0.001 to 0.5% by weight of Ca, with the rest being high-purity vacuum distilled magnesium containing impurities, which favor electromechanical potential differences and/or promote the formation of intermetallic phases, in a total amount of no more than 0.005% by weight of Fe, Si, Mn, Co, Ni, Cu, Al, Zr and P, wherein the alloy contains elements selected from the group of rare earths with the atomic number 21, 39, 57 to 71 and 89 to 103 in a total amount of no more than 0.002% by weight;

wherein a ratio of the content of Zn to the content of Ca is no more than 3, wherein the alloy contains an intermetallic phase $Ca_2Mg_6Zn_3$ and/or $Mg_2Ca$ in a volume fraction of close to 0 to 2%, and wherein the content of Zr is no more than 0.0003% by weight, and wherein the biodegradable implant has a strength of >275 MPa, and a ratio yield point of <0.8, wherein the difference between strength and yield point is >50 MPa.

2. The implant as claimed in claim 1, wherein the alloy does not contain an intermetallic phase MgZn.

3. The implant as claimed in claim 1, wherein the content of Ca is 0.2 to 0.4% by weight, and the alloy contains the intermetallic phase $Mg_2Ca$.

4. The implant as claimed in claim 1, wherein the ratio of the content of Zn to the content of Ca is no more than 1.

5. The implant as claimed in claim 1, wherein individual impurities contributing to the total sum of the impurities are present in the following amounts in % by weight: Fe ≤<0.0005; Si ≤0.0005; Mn ≤0.0005; Co ≤0.0002; Ni ≤0.0002; Cu ≤0.0002; Al ≤0.001; Zr ≤0.0003; P ≤0.0001.

6. The implant as claimed in claim 1, wherein a combination of the impurity elements Fe, Si, Mn, Co, Ni, Cu and Al totals no more than 0.004% by weight, the content of Al is no more than 0.001% by weight, and/or the content of Zr is no more than 0.0003% by weight.

7. The implant as claimed in claim 1, wherein individual elements from the group of rare earths total no more than 0.001% by weight.

8. The implant as claimed in claim 1, wherein the alloy has a fine-grain microstructure with a grain size of no more than 5.0 μm without considerable electrochemical potential differences between the individual matrix phases.

9. The implant as claimed in claim 1, wherein the alloy contains an intermetallic phase $Ca_2Mg_6Zn_3$ and/or $Mg_2Ca$ and the intermetallic phase is as noble as the matrix phase or is less noble than the matrix phase.

10. The implant as claimed in claim 9, wherein precipitates have a size of no more than 2.0 μm and are distributed dispersely at the grain boundaries or inside the grain.

11. The implant as claimed in claim 1, wherein the content of Ca is 0.001 to 0.4% by weight.

12. The implant as claimed in claim 11, wherein the content of Ca is 0.1 to 0.4% by weight.

13. The implant as claimed in claim 12, wherein a ratio of the content of Zn to the content of Ca is no more than 1.

14. The implant as claimed in claim 1, wherein individual impurities contributing to the total sum of the impurities are present in the following amounts in % by weight: Fe ≤0.0005; Si ≤0.0005; Mn ≤0.0005; Co ≤0.0002; Ni ≤0.0002; Cu ≤0.0002; Al ≤0.001; Zr ≤0.0001; P ≤0.0001.

15. The implant as claimed in claim 1, wherein a combination of the impurity elements Fe, Si, Mn, Co, Ni, Cu and Al totals no more than 0.001% by weight, the content of Al is no more than 0.001% by weight, and/or the content of Zr is no more than 0.0001% by weight.

16. The implant as claimed in claim 1, wherein individual elements from the group of rare earths total no more than 0.0003% by weight.

17. The implant as claimed in claim 16, wherein individual elements from the group of rare earths total no more than 0.0001% by weight.

18. The implant as claimed in claim 1, wherein the alloy has a fine-grain microstructure with a grain size of no more than 3.0 μm without considerable electrochemical potential differences between the individual matrix phases.

19. The implant as claimed in claim 1, wherein the alloy has a fine-grain microstructure with a grain size of no more than 1.0 μm.

20. The implant as claimed in claim 1, having a strength of >300 MPa, a yield point of >225 MPa, and a ratio yield point of <0.75, wherein the difference between strength and yield point is >100 MPa, and the mechanical asymmetry is <1.25.

21. The implant of claim 1 wherein the content of Ca is 0.001 to 0.2% by weight.

22. The implant of claim 1 wherein the content of Ca is 0.1 to 0.2% by weight.

23. A biodegradable implant comprising:

a magnesium alloy having improved mechanical and electromechanical properties, comprising 0.1 to 1.6% by weight of Zn, 0.001 to 0.5% by weight of Ca, with the rest being formed by magnesium containing impurities, which favor electrochemical potential differences and/or promote the formation of intermetallic phases, in a total amount of no more than 0.005% by weight of Fe, Si, Mn, Co, Ni, Cu, Al, Zr and P, wherein the alloy contains elements selected from the group of rare earths with the atomic number 21, 39, 57 to 71 and 89 to 103 in a total amount of no more than 0.002% by weight;

wherein the ratio of the content of Zn to the content of Ca is no more than 3, wherein the alloy contains an intermetallic phase $Ca_2Mg_6Zn_3$ and/or $Mg_2Ca$ in a volume fraction of close to 0 to 2%, and wherein the content of Zr is no more than 0.0003% by weight, and wherein the biodegradable implant has a strength of >300 MPa, and a ratio yield point of <0.75, wherein the difference between strength point and yield point is >50 MPa.

24. The implant of claim 23 wherein the ratio of the content of Zn to the content of Ca is no more than 1.

* * * * *